US008250890B2

(12) United States Patent
Morales

(10) Patent No.: US 8,250,890 B2
(45) Date of Patent: Aug. 28, 2012

(54) METHOD TO IMPROVE SOLID LUBRICANT FILM TRIBOLOGICAL PERFORMANCE AND ADHESION TO HOT FORMING MATERIAL

(75) Inventor: Arianna T. Morales, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 705 days.

(21) Appl. No.: 12/427,809

(22) Filed: Apr. 22, 2009

(65) Prior Publication Data

US 2010/0269558 A1 Oct. 28, 2010

(51) Int. Cl.
*B21B 45/02* (2006.01)

(52) U.S. Cl. ..... 72/42; 72/38; 72/47

(58) Field of Classification Search ..... 72/41, 42, 72/43, 44, 57, 60, 38, 46, 47, 342.1; 508/125, 508/150, 167
See application file for complete search history.

(56) References Cited

U.S. PATENT DOCUMENTS

| | | | | | |
|---|---|---|---|---|---|
| 3,843,529 | A | * | 10/1974 | Bertrand | 508/117 |
| 4,303,537 | A | * | 12/1981 | Laepple et al. | 508/118 |
| 4,753,094 | A | * | 6/1988 | Spears | 72/53 |
| 4,826,902 | A | * | 5/1989 | Hanabata et al. | 524/168 |
| 4,869,764 | A | * | 9/1989 | Marwick | 156/196 |
| 5,116,521 | A | * | 5/1992 | Fujii et al. | 508/163 |
| 5,534,044 | A | * | 7/1996 | Prasad et al. | 75/231 |
| 5,856,390 | A | * | 1/1999 | Gaylor et al. | 524/406 |
| 6,194,357 | B1 | * | 2/2001 | Murata et al. | 508/113 |
| 6,253,588 | B1 | | 7/2001 | Rashid et al. | |
| 7,012,226 | B1 | * | 3/2006 | George | 219/544 |
| 2006/0089270 | A1 | * | 4/2006 | Vose | 508/113 |

FOREIGN PATENT DOCUMENTS

TW 554068 * 9/2003

* cited by examiner

*Primary Examiner* — Edward Tolan
(74) *Attorney, Agent, or Firm* — Reising Ethington P.C.

(57) ABSTRACT

According to one embodiment, a film of solid lubricant particles is applied to metal workpieces, which are then subjected to a controlled humid environment for predetermined times and temperatures. Following the exposure to humidity, the lubricated metal workpieces are heated for a hot forming operation. The humidification of the lubricated workpiece increases the adhesion of solid lubricant films to the metal workpieces, thereby improving the tribological performance of the workpieces during subsequent hot forming operations.

13 Claims, 4 Drawing Sheets

METHOD TO IMPROVE SOLID LUBRICANT FILM TRIBOLOGICAL PERFORMANCE AND ADHESION TO HOT FORMING MATERIAL

TECHNICAL FIELD

This disclosure pertains to a method of improving adherence of a lubricant film, comprising small lubricant particles, on a surface of a metal workpiece intended for a hot forming operation. More specifically, this disclosure pertains to a method of subjecting lubricated metal to controlled humidity atmospheres to improve tribological performance and adhesion of the lubricant to the metal workpiece in a subsequent hot forming operation.

BACKGROUND OF THE INVENTION

In hot forming the working material is heated up to a certain temperature in which plastic deformation of the material is easier to achieve than at room temperature. Then the material is formed using a die, tool, or punch (hot or at room temperature), and a hydraulic or/and mechanical force, or viscous fluid force (hot or at room temperature) to obtain a desired shape and configuration.

Metal articles can be made by hot forming processes that use complementary forming tools in a press under the pressure of a working gas to stretch-form a preheated metal blank, for example an aluminum alloy sheet blank, against forming surfaces on the forming tools. Hot forming processes include, for example, superplastic forming (SPF), forging, warm stamping, plastic blow forming, warm hydroforming, and quick plastic forming (QPF), described in commonly-assigned U.S. Pat. No. 6,253,588.

In hot blow forming, a highly formable sheet, for example an aluminum alloy sheet, is heated, for example at about 500° C., and gripped at peripheral edges between complementary opposing dies. Pressurized air or other fluid is applied against one side of the sheet to stretch it into conformance with the forming surface of one die. The opposing die provides an air chamber on the pressurized side of the aluminum sheet. Both dies may be heated to elevated forming temperatures to maintain the sheet at a predetermined forming temperature for shaping of the sheet. The sheet may first be pressed against one die for pre-shaping, and then blown against the opposing die for finish shaping. Thus, at least one surface of the hot sheet is stretched against and over the forming surface of a die.

In production operations, heated sheet workpieces are repeatedly placed on the press, formed on the heated die(s), and removed. A lubricant may be applied to the workpieces to buffer the repeated sliding, frictional contact. Low adhesion of the lubricant to the workpieces, however, may decrease the quality of the final part by lowering the tribological performance of the material during hot forming and by increasing the number of surface defects on the final part.

SUMMARY OF THE INVENTION

The method is practiced to increase adherence of a particulate lubricant layer or film on metal workpieces intended for a hot forming process. The more adherent lubricant layer better protects the workpieces in a subsequent forming operation. The more adherent film may also permit more complete or severe forming of the workpiece(s) in a single hot forming step. According to one embodiment, lubricant particles are applied to metal workpieces, for example by spray coating, roller coating, or immersion coating. The lubricant may comprise particles dispersed in a liquid carrier for the application step. The particles may consist of at least one of boron nitride, graphite, $WS_2$, or $MoS_2$. The liquid carrier may be water or alcohol. The lubricant particle containing dispersion may also include at least one of a dispersant or surfactant additive. After suitable application the liquid carrier is evaporated or otherwise removed to leave a more or less dry film of lubricant particles. The resulting dried lubricant film may typically have a thickness of up to about 50 micrometers or so as determined to be suitable for the combination of lubricant particles, metal workpiece surface, and hot forming operation.

The metal workpiece may be composed of any suitable alloy for which a particle film lubricant may be required for a hot forming operation. For example, such lubricants may be used on workpieces of an aluminum alloy, magnesium alloy, titanium alloy, or stainless steel. In one embodiment, the metal workpiece may be an aluminum alloy 5083 sheet metal workpiece with a thickness of about 0.1 to 5 mm. The metal workpiece may be positioned in a chamber where it is then subjected to air with high relative humidity, for example about 50 to about 100% relative humidity, for a time and temperature range predetermined for the workpiece surface, lubricant material, and intended hot forming operation. The level of humidity is also suitably controlled. Suitable temperature ranges for the humidity treatment, for example, may vary from about 25° C. to 60° C. In one embodiment, the time of exposure to the humidity, for example, may vary from one to ten days. In other embodiments, longer periods of exposure to humidity may yield better adhesion of the particulate lubricant film. The exact conditions of humidity, time and temperature may vary depending on the lubricant composition, the lubricant particle size, the lubricant particle size distribution, and the average lubricant thickness. The conditions for the humidity step are chosen to achieve the desired lubricant adhesion for a particular application.

In one embodiment a single lubricated workpiece may be humidified for a hot forming operation. But in many instances many lubricated workpieces will be prepared for hot forming by a common hot forming step. The workpieces may be arranged in the humidification chamber such that the humid air contacts each of the lubricated surfaces.

Following the exposure to humidity, the lubricated metal workpieces are taken out of the chamber. Subject only to other preliminary workpiece preparation steps, the lubricant film coated workpieces are ready for a hot forming operation. Each workpiece may be heated as required for the hot forming operation. In the event that a workpiece is heated but the forming not immediately performed, the workpiece may be cooled and reheated as necessary. In one embodiment, for example, humidified film lubricated AA5083 workpieces may be heated a temperature of about 300° C. for warm forming or hot stamping or to about 500° C. for hot blow forming.

Thus, a lubricated metal workpiece is subjected to a humidification step under conditions determined (for example, experimentally) to best improve lubricant adhesion for the workpiece material and surface, and for the intended hot forming operation. The workpiece may be heated and formed immediately after humidification. Or the workpiece may be stored after the humidification process, and then formed at a later time.

Increasing the adhesion improves the tribological performance of the workpieces during hot forming operations and may reduce the number of surface defects on parts manufactured during the hot forming operations. In addition, the method increases the adhesion of lubricant to non-conformant lubricated material and thus eliminates the need to scrap the material, or remove the lubricant and re-spray the material with fresh lubricant.

DESCRIPTION OF PREFERRED EMBODIMENTS

Figure 1:
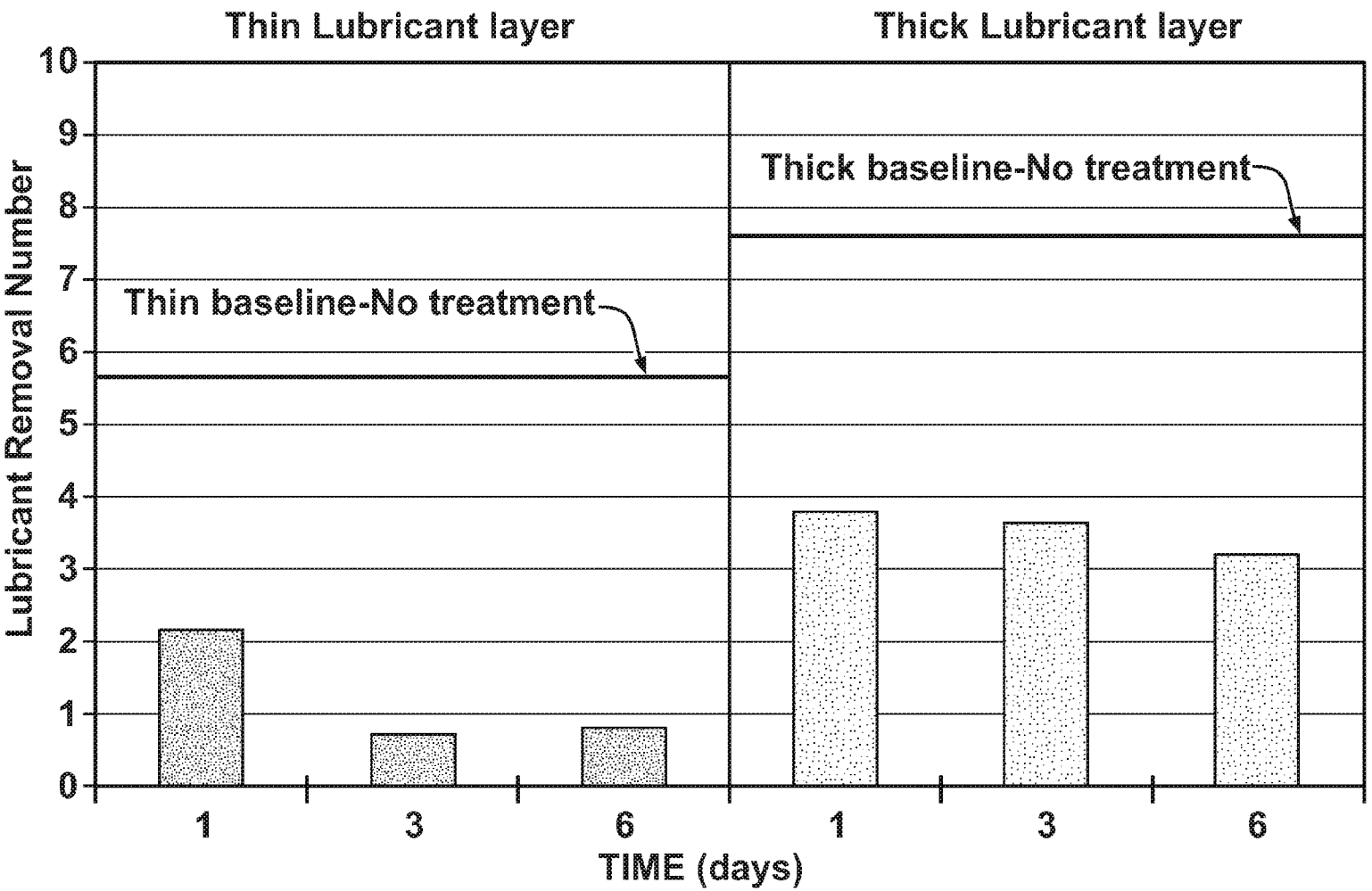
FIG. 1 shows results of the measure of adhesion of lubricant to metal, for lubricated sheet metal samples subjected to controlled atmospheres and temperatures according to one method of the invention, compared to untreated lubricated metal.

A workpiece subjected to hot metal forming may be lubricated. The lubricant may serve, for example, to provide lubrication as the metal slides against a forming surface, and/or to release a formed workpiece from the tool at the completion of the forming operation. One of the most important characteristics of the lubricant layer is its adhesion to the metal. Low adhesion may decrease the quality of the final parts by lowering the performance of the material during forming, and by increasing the number of surface defects on the parts. One embodiment includes a method of improving the adhesion and tribological performance of solid lubricant films on a metal workpiece. The method significantly increases the adhesion of the lubricant to the metal, and may reduce the number of surface defects on the formed parts, thus improving the surface quality of the parts. The method may also decrease surface finishing costs.

In addition, the method can be used to process lubricated material that does not comply with minimum adhesion requirements. As known to those in the art, lubricated material without enough adhesion must be washed and re-sprayed with lubricant, thus increasing the cost of processing non-conforming material. When the adhesion of the lubricant is improved according to the method of the invention, removal and re-spraying of the lubricant for non-conforming lubricated materials becomes unnecessary. Thus, the method may completely eliminate costs associated with lubricant removal and reapplication.

The adhesion of solid lubricant films to metal may depend on the lubrication process parameters and on the lubricant particle size and particle size distribution. Any suitable solid particulate lubricant may be used, for example but not limited to, at least one of boron nitride (BN), graphite, $WS_2$, or $MoS_2$. The particulate lubricant may be dispersed or suspended in any suitable liquid, for example but not limited to at least one of water or alcohol. The particles may be of any suitable size. In one embodiment, the average particle size in the lubricant may be about 5 microns. In one embodiment, 95% of the particles in the lubricant are less than 5 microns. The lubricant may also include at least one of a dispersant or surfactant to increase the homogeneity of the lubricant.

According to one embodiment, the lubricant is first applied to a metal workpiece by any suitable method, for example but not limited to, spraying, dipping, or rolling. The metal workpiece may be, for example but not limited to, aluminum alloys, magnesium alloys, or titanium alloys. Where the metal workpiece is a sheet, the workpiece may be composed of any material prepared in sheets to be used in a hot forming process with a solid lubricant. Where the metal workpiece is a sheet, the thickness of the sheet metal workpiece may be any suitable thickness, for example but not limited to, about 0.5 mm to about 5 mm.

A suitable liquid suspension of the lubricant, for example boron nitride, may be sprayed on the surface of the metal workpiece. The liquid vehicle such as water or alcohol is selected so that it will evaporate either at ambient temperature or upon heating of the metal workpiece. The lubricant is applied and dried before the lubricated workpiece is subjected to the humid atmosphere and heat according to a method of the invention. The thickness of the resulting lubricant film after the liquid vehicle evaporates may be about 1 micrometer to about 100 micrometers. In one embodiment, the thickness of the lubricant film may be about 50 micrometers or less.

After the lubricant is applied to the metal workpiece, the lubricated workpiece is positioned inside a chamber and subjected to controlled humid atmospheres at precise times and temperatures. The chamber may be any suitable enclosure for the workpiece, for example but not limited to, a box, cavity, or room. In one embodiment, the humidity level may be about 50 to about 100%. In one embodiment, the humidity level may be about 80 to about 100%. In another embodiment, the humidity level may be about 100%. In one embodiment, the temperature range for the treatment varies from about 25° C. to about 60° C. In another embodiment, the temperature range for the treatment varies from about 25° C. to about 45° C. In another embodiment, the temperature range for the treatment varies from about 35° C. to about 45° C. The time of exposure to the humidity may be at least 1 day. In one embodiment, the time of exposure varies from about 1 day to about 10 days. In another embodiment, the time of exposure varies from about 1 day to about 3 days. The level of humidity, temperature, and time of exposure are selected to increase the adhesion of the lubricant to the desired level.

Following the exposure to humidity, the lubricated workpiece is heated at precise and controlled times and temperatures. For example, in one embodiment the lubricated workpiece may be heated at about 300° C. to about 550° C. In another embodiment, the lubricated workpiece may be heated at about 450° C. In one embodiment, the lubricated workpiece may be heated for about 1 minute to about 10 minutes. In another embodiment, the lubricated workpiece may be heated for about 5 minutes. The temperature and time of exposure to the heat are selected to increase the adhesion of the lubricant to the desired level.

The conditions used for the exposure to humidity and heating may depend on the lubricant particle size and particle size distribution, and on the average lubricant thickness.

After the lubricated metal workpiece is subjected to the humidity and heating steps, the workpiece may be formed in a hot forming operation into a product. In one embodiment, the workpiece may be hot formed immediately after the humidity and heating process is complete. Or the workpiece may be cooled after the humidity and heating process, and then hot formed at a later time. Or the heating step may be part of the hot forming operation.

Experiments were conducted to test the effect of exposing sheet metal with two nominal lubricant thicknesses to 100% humidity at various temperatures. The sheet metal samples were made of AA5083. Aluminum alloy 5083 has a typical composition, by weight, of about 4% to 5% magnesium, 0.3 to 1% manganese, a maximum of 0.25% chromium, about 0.1% copper, up to about 0.3% iron, up to about 0.2% silicon, and the balance substantially all aluminum. A boron-nitride lubricant was sprayed on the sheet metal. Ninety-five percent of the particles in the lubricant had a diameter of less than 5 microns.

Three samples were evaluated for each experimental condition. The samples were lubricated to either a first or second thickness of lubricant film. The first thickness, designated as "thin", was about 5 to about 9 micrometers, or 0.00020 inch to 0.00035 inch. The second thickness, designated as "thick", was about 12 to about 17 micrometers, or 0.00045 inch to 0.00060 inch.

The workpieces were exposed to the 100% humidity during 1, 3, and 6 days at 32.2° C., 37.8° C., and 43.3° C. Exposure to humidity was conducted using the Q-FOG Cyclic Corrosion Chamber, Model CCT1100 available from the Q-Lab Corporation, Cleveland, Ohio. The samples were hung inside the humidity chamber using clamps. Chamber temperature and humidity were controlled by a microprocessor. After the designated time periods (1, 3, and 6 days), the samples were taken out of the chamber and left to cool in air to room temperature. Lubricant adhesion tests were performed after four hours at room temperature on half of the samples.

The other half of the samples were heated to 450° C. using a Vulcan Box Furnace (50° C.-1100° C., ±5° C.), available from DENTSPLY NEYTECH, Burlington, N.J. The samples were kept in the furnace for 5 minutes and then air-cooled to room temperature. Optical evaluation of the lubricated surfaces was performed after all experimental steps.

Lubricant adhesion measurements were made at three different times: on the as-received samples before the samples were subjected to the 100% humidity condition, on the samples after exposure to the humidity, and on the samples after exposure to heating. Measurements of the coefficient of friction were made twice: on the as-received samples before the samples were subjected to humidity, and on the samples after exposure to humidity but before heating.

Twenty "thin" samples (having lubricant film 5 to 9 micrometers thick) and twenty "thick" samples (having lubricant film 12 to 17 micrometers thick) were selected as control samples not subjected to 100% humidity. Ten thick and ten thin samples were used to determine the as-received lubricant adhesion. The remaining ten thick and ten thin samples were heated at 450° C. for 5 minutes in the Vulcan Box Furnace, and then lubricant adhesion measurements were performed after the samples cooled to room temperature.

Lubricant adhesion measurements were made as follows. Adhesion of the solid film lubricant to the sheet metal was evaluated using a "rubbing under load" test. The test consists of rubbing the lubricated sheet metal using controlled and fixed movement and load, and then determining the amount of lubricant removed from the surface by the action of the applied load and motion. The more lubricant is removed from the surface, the higher the "lubricant removal number." Thus, higher lubricant removal numbers indicate that the lubricant is less adherent to the sheet metal surface. The removal numbers range from zero to 10. Zero indicates no detection of lubricant removal from the surface by the movement and load applied, and thus, a lubricant with very good adherence.

FIG. 1 shows the lubricant removal number for lubricated metal subjected to controlled atmospheres and temperatures as described above, compared to untreated lubricated metal. As shown in FIG. 1, the adhesion of lubricant to sheet metal improved for both the thin and thick samples that were treated according to a method of the invention. The adhesion to the sheet metal was much better in the treated samples than in regular production samples (baselines for each condition). This improvement is seen for all times (1, 3, and 6 days) of exposure to humidity and for both thin and thick lubricant thicknesses.

Figure 2:
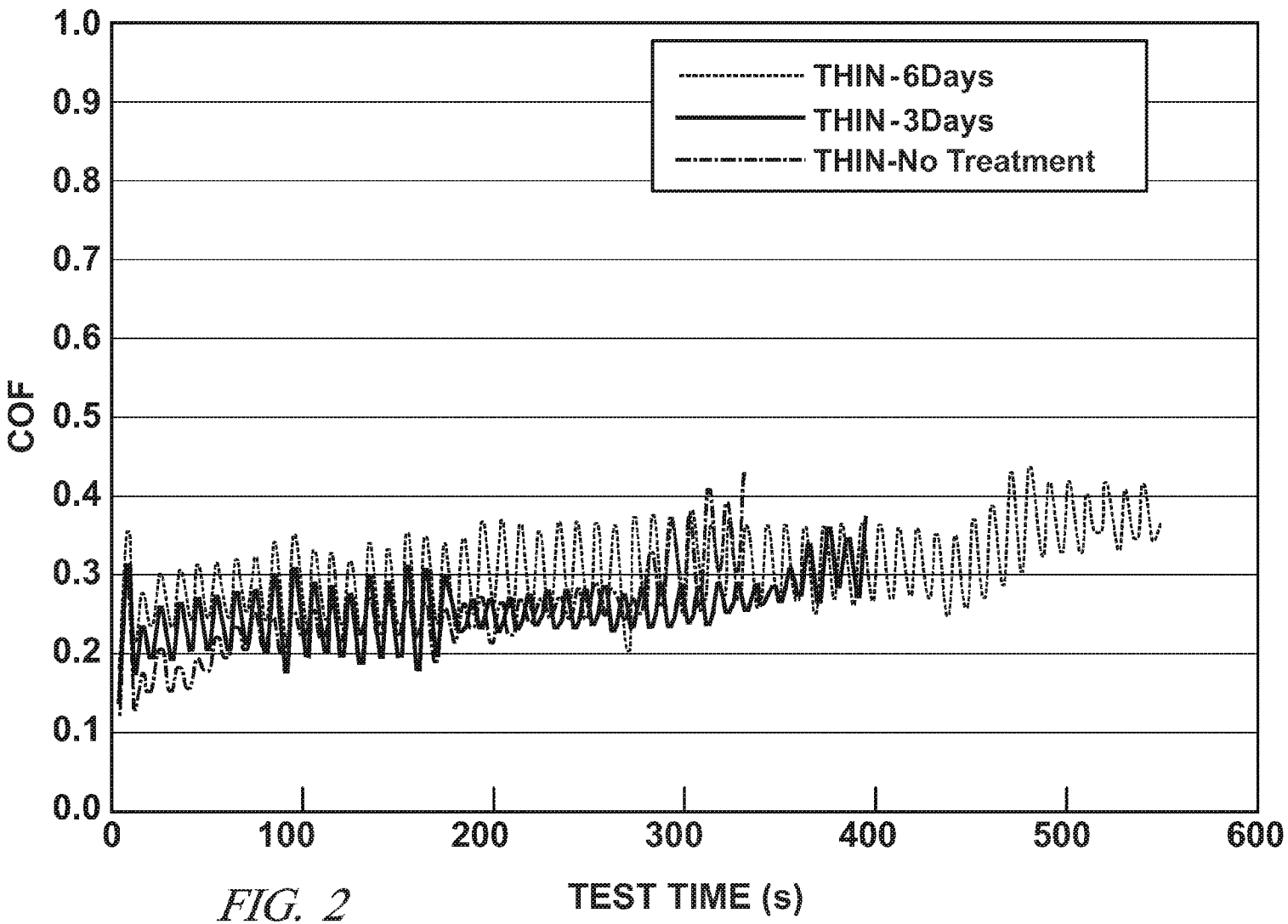
FIG. 2 shows the friction coefficient as a function of the test time for metal samples having a thin lubricant film subjected to controlled atmospheres and temperatures according to one method of the invention, compared to untreated lubricated metal.
Figure 3:
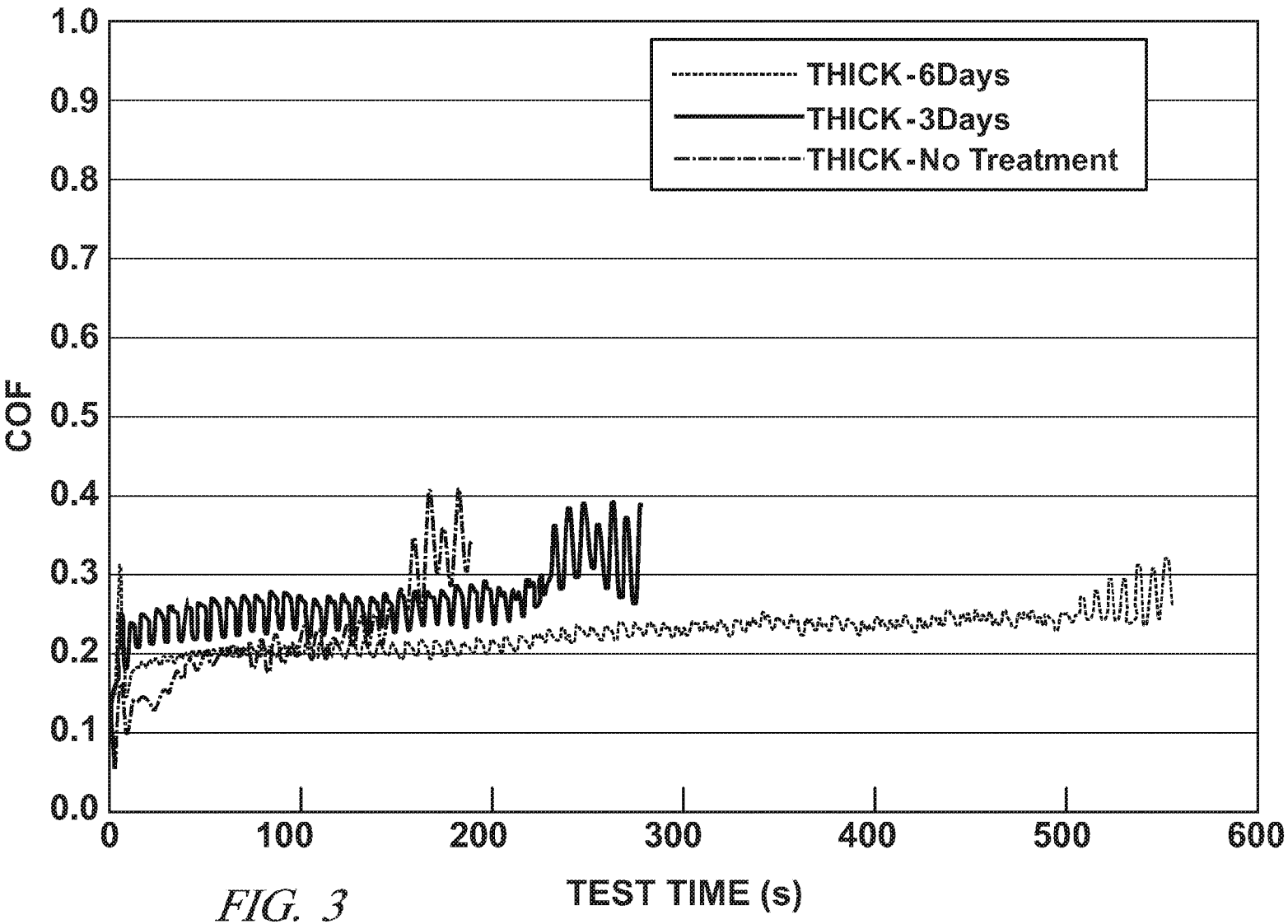
FIG. 3 shows the friction coefficient as a function of the test time for metal samples having a thick lubricant film subjected to controlled atmospheres and temperatures according to one method of the invention, compared to untreated lubricated metal.

FIGS. 2 and 3 show the improvement in the tribological behavior of the treated material in comparison to non-treated sheet metal, measured using flat-on-flat reciprocating tribological testing at low sliding speed (0.1 Hz) and high temperature (450° C.). The tribological properties of the lubricated material with and without treatment were measured using a Plint TE-77 high frequency friction machine modified to achieve low sliding speed. The machine was used to evaluate the effect of different lengths of treatment and lubricant thicknesses on the tribological behavior of the samples. For the flat-on-flat reciprocating tribological testing method used for the samples of FIGS. 2 and 3, the lubricated samples had dimensions of 95 mm by 59 mm to fit the specimen stage on a modified Plint TE-77 machine. The flat-on-flat reciprocating testing method involves contact between two flat specimens: the upper steel partner, which simulates the forming tool, and the lower partner, the lubricated sheet metal. The upper steel partner slides in reciprocating motion against the fixed lubricated sheet metal at the temperature of interest. The data acquisition system recorded data every 0.1 second. The data acquisition system of the Plint machine automatically recorded friction coefficient (FC), electric contact potential (CP), load, temperature, and frequency during each of the tests. Three tests per each condition and lubricant thickness were conducted.

FIGS. 2 and 3 show the coefficient of friction over time for untreated samples, samples treated for three days, and samples treated for six days. The samples in FIG. 2 had thin lubricant film, whereas the samples in FIG. 3 had thick lubricant film. The two figures show that the treated samples had much better lubricant adhesion than the non-treated samples, and they show improvements in the treatment for longer times at the same temperature.

Figure 4:
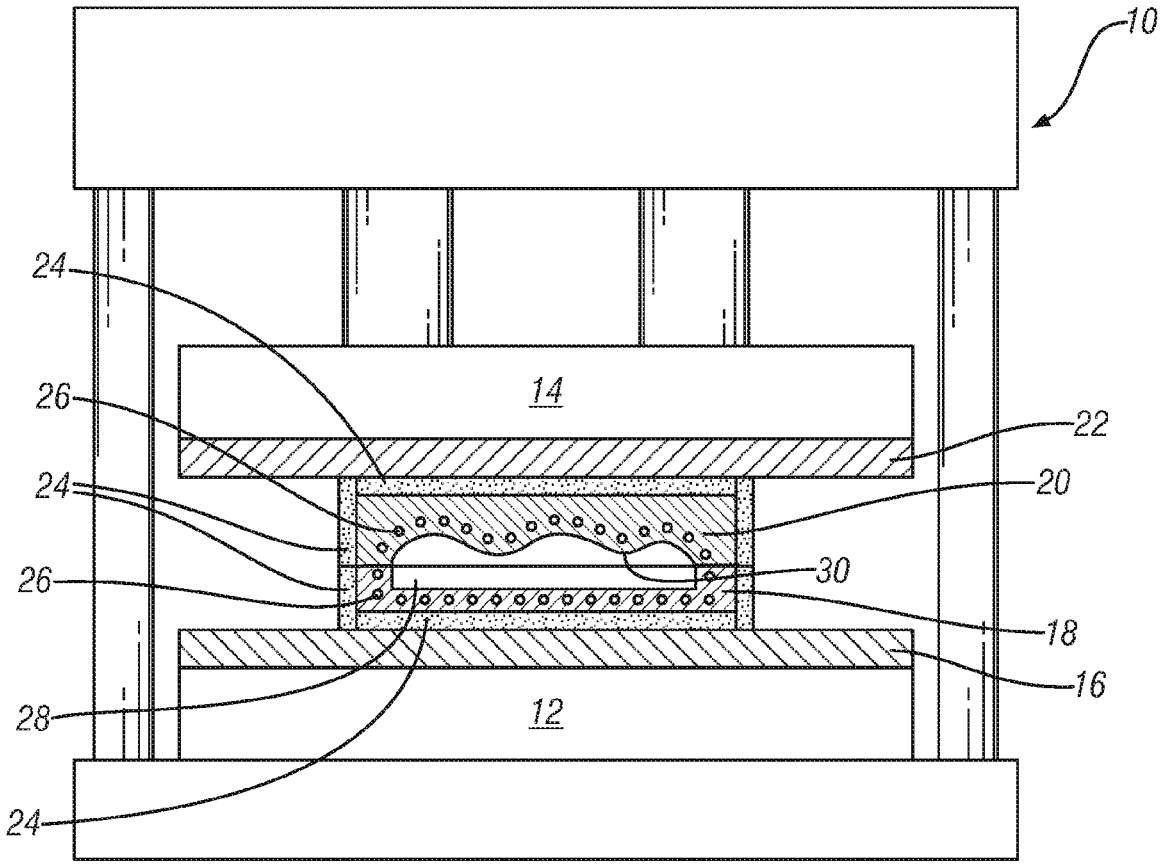
FIG. 4 is a schematic view of representative heated tools for hot blow forming of metal blanks. The tools are made of a tool steel alloy and internally heated to forming temperatures.

The metal workpieces treated according to a method of the invention may subsequently be formed in any suitable hot forming process. FIG. 4 illustrates a hydraulic press 10 for hot blow forming of metal sheet workpieces into useful articles according to one embodiment. Such useful articles may include automotive vehicle closure panels, for example inner and/or outer lift gate panels or door panels. Referring to FIG. 4, hydraulic press 10 comprises a stationery lower platen 12 and a vertically movable upper platen 14. A layer of thermal insulation 16 is placed on lower platen 12 and an internally heated lower hot blow forming tool 18 (shown in cross-section) is located on thermal insulation 16. Similarly, movable upper platen 14 carries an internally heated upper forming tool 20 (shown in cross-section) that is thermally separated from upper platen 14 by a layer of thermal insulation 22.

Still referring to FIG. 4, the forming tools 18, 20 may be formed of a suitable tool steel, for example, P20, a chromium, molybdenum tool steel with, typically, 0.35 percent by weight of carbon. The bases and sides of each forming tool 18, 20 are covered with thermal insulation (indicated generally with numeral 24). Each forming tool 18, 20 is heated with a suitable number of electrical resistance heating rods (e.g., 26)

placed to maintain the tools and forming surfaces at suitable hot blow forming temperatures, which may be about 500° C.

In the illustration of FIG. 4, lower forming tool 18 is shaped to provide a high pressure air chamber 28 for applying a scheduled program of varying forming pressures against one side of a preheated lubricated metal sheet blank (not shown). Upper tool 20 is machined and polished to present a forming surface 30 for a succession of many sheet metal workpieces. In sheet metal forming operations, press 10 is actuated by means (not illustrated) to lift upper forming tool 20 for placement (often by a robot) of a preheated aluminum alloy sheet (also at about 500° C.) between the tools 18, 20. Tool 20 is lowered to grip the edges of the sheet workpiece between the sealing beads (not shown) on the sides of the tools. Fluid (often air) is then introduced into chamber 28 in accordance with a pressure schedule to progressively stretch the sheet into compliant contact with surface 30 of tool 20. After a period of minutes the upper tool 20 is raised for careful removal of the hot stretch formed part.

The practice of the invention has been illustrated with certain embodiments but the scope of the invention is not limited to such examples.

The invention claimed is:

1. A method of increasing the adhesion of a lubricant to at least one metal workpiece for subsequent hot forming of the metal workpiece, the method comprising:

applying lubricant particles dispersed in a liquid carrier to a surface of at least one metal workpiece and removing the liquid carrier to form a lubricant film over the metal workpiece surface, wherein the lubricant film consists of particles of at least one of boron nitride, graphite, $WS_2$, or $MoS_2$, and wherein the lubricant film of the particles has a predetermined thickness of up to about 100 micrometers;

positioning the metal workpiece in a humidified air chamber;

exposing the metal workpiece in the chamber to a predetermined level of relative humidity of about 50 percent to about 100 percent, for a predetermined humidification period of time of at least one day, and at a predetermined humidification temperature, comprising selecting the predetermined level of humidity, humidification time, and temperature to increase the adhesion of the lubricant film of the particles to the metal workpiece;

removing the metal workpiece from the chamber; and thereafter heating the metal workpiece for a hot forming operation on the lubricated surface of the metal workpiece.

2. A method as set forth in claim 1 wherein the predetermined humidification temperature is about 25° C. to about 60° C.

3. A method as set forth in claim 1 wherein the predetermined level of relative humidity is about 80 percent to about 100 percent.

4. A method as set forth in claim 1 wherein the predetermined humidification period of time is about 1 day to about 10 days.

5. A method as set forth in claim 1 wherein the liquid carrier comprises at least one of water or alcohol.

6. A method as set forth in claim 1 wherein the dispersion of lubricant particles in the liquid carrier comprises a surfactant or dispersant, and following removal of the liquid carrier, the lubricant film of particles further consists of the surfactant or dispersant.

7. A method as set forth in claim 1 wherein the particles have an average diameter of about five micrometers.

8. A method as set forth in claim 1 wherein the lubricant film has a thickness of about 5 to about 9 micrometers.

9. A method as set forth in claim 1 wherein the lubricant film has a thickness of about 12 to about 17 micrometers.

10. A method as set forth in claim 1 wherein the metal workpiece comprises aluminum alloy 5083.

11. A method as set forth in claim 1 wherein the metal workpiece comprises one of an aluminum alloy, magnesium alloy, or titanium alloy.

12. A method as set forth in claim 1 wherein the metal workpiece is a metal sheet.

13. A method as set forth in claim 12 wherein the hot forming operation comprises heating the metal sheet, stretching at least a portion of the metal sheet so that one side of the sheet is brought into contact with a shaping surface by applying a working gas pressure to the opposite side of the sheet, and wherein the stretching is accomplished by continually increasing the working gas pressure to a final stretching pressure.

* * * * *